US007029091B2

(12) United States Patent
Stellbrink et al.

(10) Patent No.: US 7,029,091 B2
(45) Date of Patent: Apr. 18, 2006

(54) INKJET CONSUMABLE CARTRIDGE WITH INTEGRATED NOZZLE CAP

(75) Inventors: Joseph Stellbrink, Lebanon, OR (US); Craig D. Sunada, Vancouver, WA (US); Eric Ahlvin, Corvallis, OR (US); Joseph R. Elliot, Corvallis, OR (US); Pierre Kaiser, Portland, OR (US); Kevin D. O'Hara, Washougal, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 10/633,619

(22) Filed: Aug. 5, 2003

(65) Prior Publication Data

US 2005/0030336 A1 Feb. 10, 2005

(51) Int. Cl.
*B41J 2/165* (2006.01)
*B41J 2/175* (2006.01)

(52) U.S. Cl. ..... 347/29; 347/30; 347/32; 347/86

(58) Field of Classification Search ..... 347/22–24, 347/29, 30, 32, 33, 49, 36, 35, 85–87, 101, 347/108; 355/18; 358/296, 302, 502; 400/88, 400/612; 396/429
See application file for complete search history.

(56) References Cited

U.S. PATENT DOCUMENTS 5,563,638 A 10/1996 Osborne
5,646,665 A * 7/1997 Swanson et al. ..... 347/87
5,682,186 A * 10/1997 Bohorquez et al. ..... 347/29
6,050,672 A * 4/2000 Matsuhashi ..... 347/36
6,076,851 A 6/2000 Davis, Jr. et al.
6,089,642 A 7/2000 Davis, Jr. et al.
6,102,518 A 8/2000 Taylor
6,135,585 A 10/2000 Johnson et al.
6,260,961 B1 7/2001 Seu et al.
6,270,182 B1 8/2001 Silverbrook et al.
6,398,352 B1 6/2002 Morita
6,402,290 B1 6/2002 Johnson et al.
6,409,304 B1 6/2002 Taylor
6,416,160 B1 7/2002 Silverbrook
6,471,202 B1 10/2002 Sugimura
6,471,329 B1 10/2002 Maza
6,474,773 B1 11/2002 Silverbrook et al.
6,497,471 B1 12/2002 Gargir
6,497,473 B1 12/2002 Kim
6,523,933 B1 * 2/2003 Hirano et al. ..... 347/36

FOREIGN PATENT DOCUMENTS

EP 0 671 273 9/1995
EP 0 861 732 9/1998
EP 0 861 733 9/1998
EP 0 867 297 9/1998

* cited by examiner

*Primary Examiner*—Shih-Wen Hsieh

(57) ABSTRACT

An inkjet consumable cartridge having an inkjet cartridge having nozzles. The inkjet consumable cartridge also has an inkjet cartridge holding device for holding the inkjet cartridge, a cap configured to interface with the inkjet cartridge, and a cap actuator that, when actuated, moves the cap from a position where the cap does not interface with the inkjet cartridge to a position where the cap interfaces with the inkjet cartridge sealingly covering the nozzles. Furthermore, the consumable cartridge is removable from a printer as a self-contained unit.

49 Claims, 10 Drawing Sheets

INKJET CONSUMABLE CARTRIDGE WITH INTEGRATED NOZZLE CAP

BACKGROUND OF THE INVENTION

Inkjet printers are well known in the art. A typical modern inkjet printer comprises electronic circuitry that enables the printer to receive electrical signals from a personal computer, for example, and convert signals into control signals that control an inkjet cartridge. Inkjet cartridges for such inkjet printers typically include a contact strip having contact points and nozzles. The contact points of the inkjet cartridge are used to receive electric signals from the printer to which the cartridge is connected. The signals are used to control nozzles in the inkjet cartridges. In thermally activated inkjet cartridges, each cartridge has heater circuits and resistors that are energized via the electrical signals, permitting a controlled amount of ink to be delivered from the inkjet cartridge to print media, such as paper or photographic quality sheets.

Inkjet cartridges are increasingly becoming more sophisticated and complex in their construction. Longer lifetimes are also required of cartridges, particularly those for use with printers having an off-carriage ink reservoir which replenishes the cartridge's ink supply. This has lead to greater sophistication in the so-called "servicing" of cartridges by a printer. It is normal procedure for printers to have a service station at which various functions are performed on the cartridges while they are mounted in the printer carriage such as wiping, spitting and capping. See for example U.S. Pat. No. 5,585,826. Wiping comprises moving a wiper of a specified material across the printhead of a cartridge to remove paper dust, ink spray and the like from the nozzle plate of the printhead. Spitting includes the ejection of ink into a waste ink containment area, and is performed to prevent ink in nozzles which have not been fired for some time from drying and crusting.

In many current inkjet printers, the inkjet cartridge is a consumable component. That is, when all the ink in the inkjet cartridge is used, the inkjet cartridge is disposed of or recycled and a new cartridge is placed into the printer. Still, even though the inkjet cartridge is a consumable component, it is desirable to increase the life expectancy of the cartridge. Specifically, it is known that because most of the life of an inkjet cartridge is spent "waiting" to be used (i.e. the inkjet cartridge is not printing), the nozzles of the inkjet cartridge can degrade.

Prior solutions to this degradation problem included leaving the inkjet cartridge in the printer or providing a separate "humidor" for the inkjet cartridge after it is removed from the printer. While this is acceptable for keeping the nozzles in proper working order, it is often cumbersome in that it does not lend itself to a simple, swappable and easy-to-use combined ink and media consumable design. Furthermore, in the case of a humidor, manual capping is required if the inkjet cartridge is removed from the printer. In the case where the inkjet cartridge is left in the printer, priming ink is required to bring the nozzles back to working order.

Thus, there is a need for a device that will allow an inkjet cartridge, in combination with media, to be quickly removed from a printer for extended periods of times, and/or for a device that will permit an inkjet cartridge to b maintained in working order for an extended period of time between printing jobs. Still further, there is a need for a device that will permit a consumable, including an inkjet cartridge, to be quickly and easily removed from a printer during periods of non-use and/or when a different inkjet cartridge is desired to be used, such as, by way of example, when different inks and/or printing media is needed, etc., by using a simple and easy method of sealing the nozzles from the ambient atmosphere.

The prior art has attempted to deal with the situation by providing a cap that is contained in the printer. The problem with this is that a cap that is used with more than one inkjet cartridge can transfer residue from a previous cartridge to the next inkjet cartridge. Thus, there is a need for a device that will allow for sealing of nozzles via a device that is dedicated to an individual print cartridge, but is easily and readily available for use.

SUMMARY OF THE INVENTION

In one embodiment of the present invention, there is an inkjet consumable cartridge, comprising, an inkjet cartridge having nozzles, an inkjet cartridge holding device for holding the inkjet cartridge, a cap configured to interface with the inkjet cartridge, and a cap actuator that, when actuated, moves the cap from a position where the cap does not interface with the inkjet cartridge to a position where the cap interfaces with the inkjet cartridge sealingly covering the nozzles, wherein the consumable cartridge is removable from a printer as a self-contained unit.

In another embodiment of the present invention, there is a method of making an inkjet consumable cartridge, comprising, obtaining an inkjet cartridge having nozzles, placing the inkjet cartridge in an inkjet cartridge holding device, obtaining a cap configured to interface with the inkjet cartridge, attaching the cap to a cap actuator, and attaching the cap actuator with the cap to the inkjet cartridge holding device such that, when actuated, the cap actuator moves the cap from a position where the cap does not interface with the inkjet cartridge to a position where the cap interfaces with the inkjet cartridge sealingly covering the nozzles, wherein the consumable cartridge is a self-contained unit.

DETAILED DESCRIPTION OF SOME OF THE EMBODIMENTS

Figure 1A:
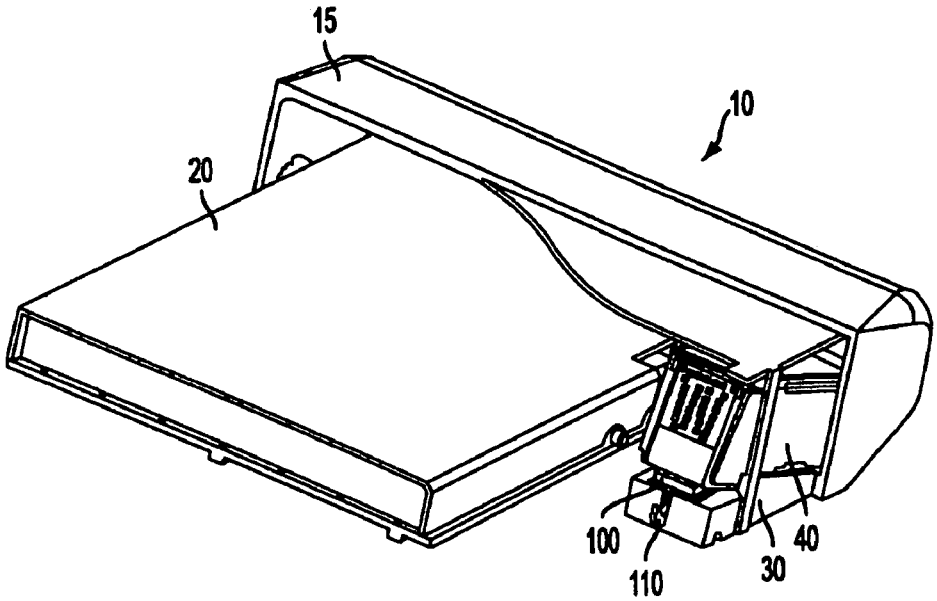
FIG. 1*a* is an isometric view of one exemplary embodiment of the consumable cartridge consistent with the present invention.
Figure 1B:
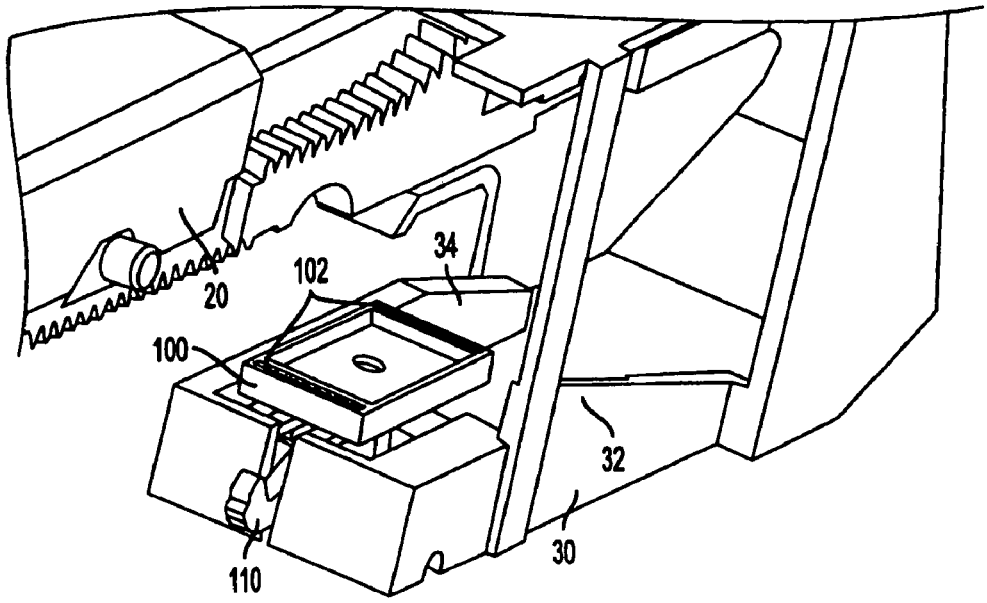
FIG. 1*b* is a close-up view of a portion of the view of FIG. 1*a*.

In one embodiment of the present invention, as shown in FIGS. 1*a* and 1*b*, there is a consumable cartridge 10 for an exemplary inkjet printer comprising a print media holding device 20 and an inkjet cartridge holding device 30 which is adapted to hold an inkjet cartridge 40 having nozzles. The consumable cartridge 10 also has a cap 100 that is configured to interface with the inkjet cartridge 40 when inkjet cartridge is placed in the inkjet cartridge holding device 30. Furthermore, the consumable cartridge 10 has a cap actuator 110 that is adapted to move the cap. In the embodiment of the invention shown in FIGS. 1*a* and 1*b*, the cap actuator 110 is adapted to move the cap from a position where the cap 100 does not interface with the inkjet cartridge to a position where the cap 100 interfaces is with the inkjet cartridge.

Figure 2:
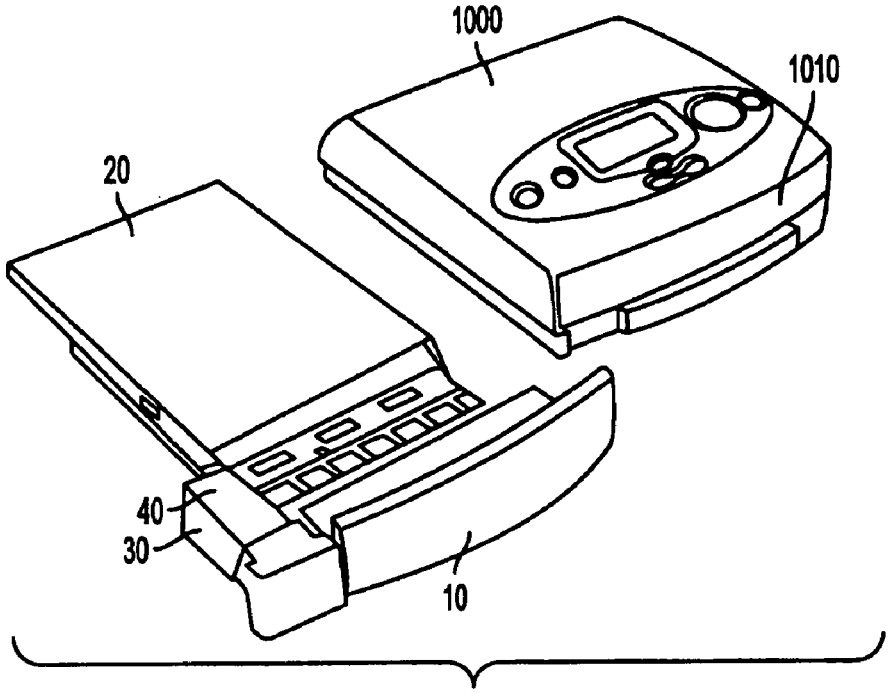
FIG. 2 is an isometric view of the exemplary consumable cartridge shown in FIG. 1*a* with a printer consistent with the present invention.

The embodiment of the present invention shown in FIG. 1*a* is compatible with the exemplary printer 1000, as shown in FIG. 2. The exemplary embodiment shown is a compact, portable printer dedicated to printing 4"×6" photographic-quality prints. In the exemplary embodiment, the consumable cartridge 10 is a self-contained unit that retains the inkjet cartridge 40 in the body of the consumable cartridge 10 and is configured to be installed into a printer. Once installed into a printer, the printer 1000 grips the inkjet cartridge 40 with a print carriage (discussed in greater detail below), after which the inkjet cartridge 40 is released from the consumable cartridge 10. Prior to removing the consumable cartridge 10 from the exemplary printer 1000, the inkjet cartridge is reattached to the consumable cartridge 10, after which the printer releases the inkjet cartridge 40. After the inkjet cartridge 40 is reattached to the consumable cartridge 10 and the exemplary printer 1000 releases the inkjet cartridge, the consumable cartridge 10 is removed from the printer.

Figure 3:
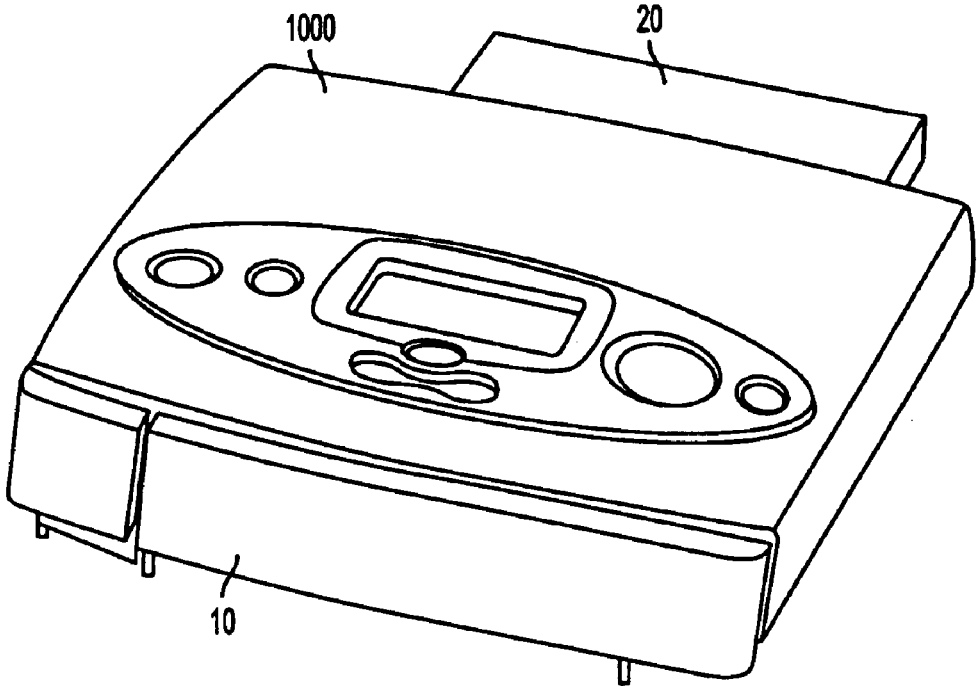
FIG. 3 is an isometric view of the exemplary consumable cartridge installed in a printer consistent with the present invention.

The exemplary printer 1000 of FIG. 2 has an opening 1010 in which is inserted the consumable cartridge 10 with its attendant print media holding device 20, inkjet cartridge holding device 30, and inkjet cartridge 40 (approximate location). Thus, the exemplary printer 1000 is designed to be compatible with the consumable cartridge of the present invention. FIG. 3 shows the consumable cartridge 10 installed in the exemplary printer 1000. As can be seen from the figure in this embodiment, the print media holding device 20 extends through the exemplary printer 1000. The function of the present invention when the consumable cartridge 10 is installed in the printer will be discussed in further detail below.

Figure 5:
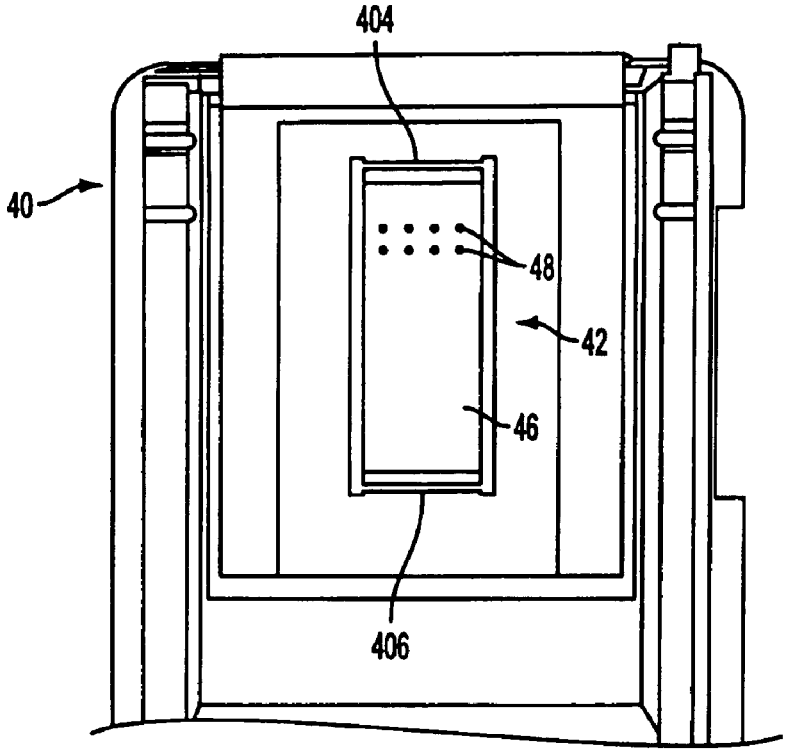
FIG. 5 is a bottom view of the inkjet cartridge of FIG. 4.

FIG. 1*b* is a close up view of the area around the inkjet cartridge holding device 30 with the inkjet cartridge 40 removed. As can be seen from FIG. 1*b*, the cap 100 of the first embodiment is a rectangular cap having four side walls and a bottom surface. The purpose of the cap 100 is to form a seal on the bottom of the inkjet cartridge 40, thus isolating or substantially isolating the nozzles of the cartridge from the ambient atmosphere. The side walls of the cap extending upward from the bottom surface form a cavity in the cap. In the first embodiment, the cap 100 is made from an elastomeric material such as rubber, silicone, EPDM, etc. In the embodiment shown in FIG. 1*b*, cap 100 has indentations 102 in the tops of the side walls. The indentations on the cap 100 form a redundant seal to cope with cap 100 placement tolerances as well as the possibility that part of the cap 100 may be positioned on the uneven "encapsulant" or "potting" bead of some embodiments of the inkjet cartridge 40. The encapsulant 404 and 406 of the present invention lies along the top and bottom of the nozzle plate 48 (discussed in greater detail below) and is shown in FIG. 5. In the event that an edge of the cap 100 contacts part of the encapsulant, the other edges will contact outside the encapsulant area and still provide a good seal around the nozzles. In this manner, the indentations 102 compensate for tolerance stack-ups on the exemplary printer 1000 (with respect to, cap location, for example) and on the inkjet cartridge 40 (encapsulant bead size, location, etc.).

Some embodiments of the present invention will have these indentations 102 while others will not. Still further, some embodiments of the present invention will have these indentations 102 on all four side walls. That is, the indentations 102 can be located anywhere on one or more of the top surfaces of the side walls. By way of example and not by way of limitation, one side wall, two side walls, three side walls or four side walls can have these indentations 102. Furthermore, the indentations 102 do not necessarily have to extend the full length of the cavity of the cap. Still further, caps can have vents designed to regulate the pressures exerted on the nozzles, while maintaining a high humidity environment around the nozzles.

Figure 4:
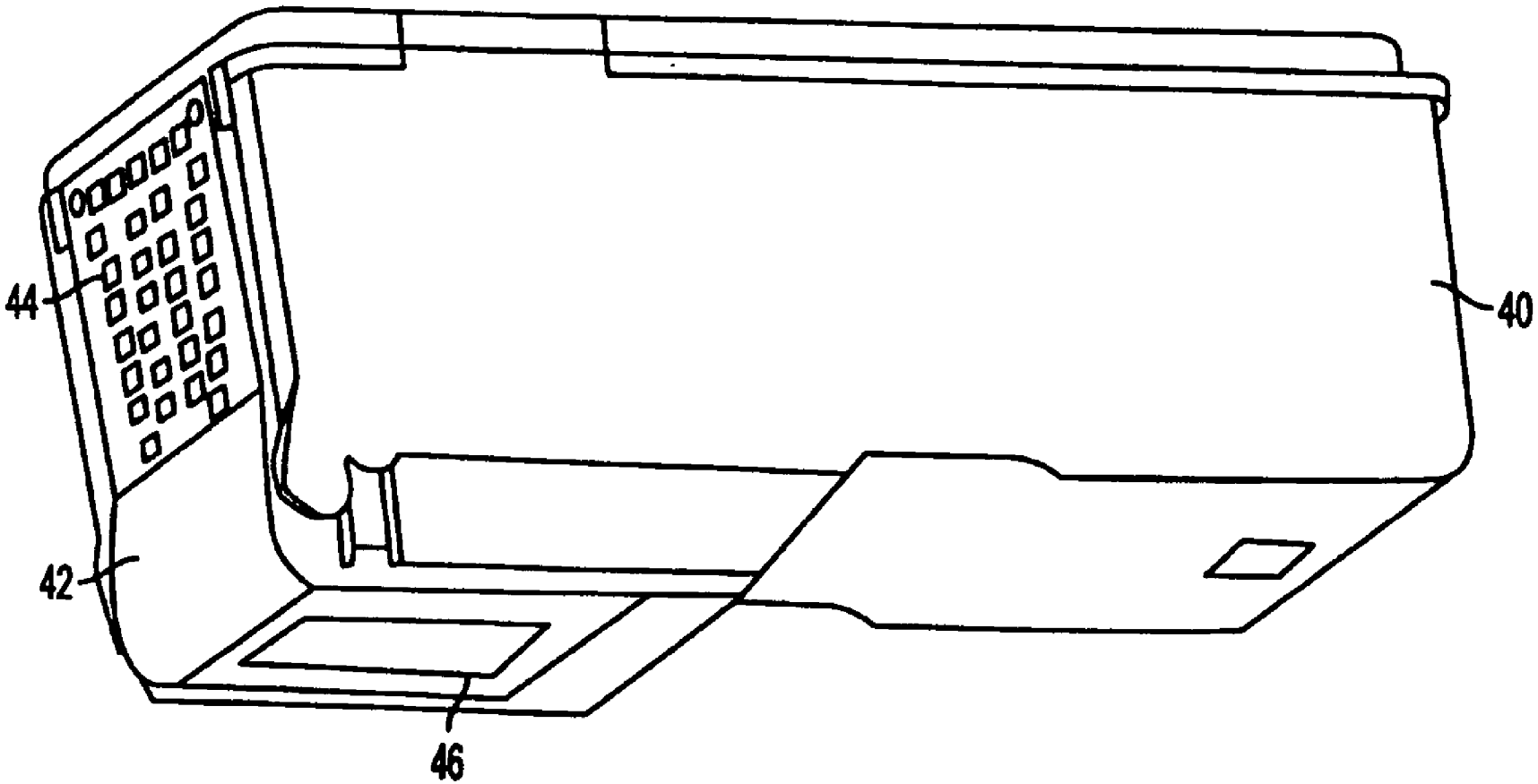
FIG. 4 is an isometric view of an exemplary inkjet cartridge consistent with the present invention.
Figure 6:
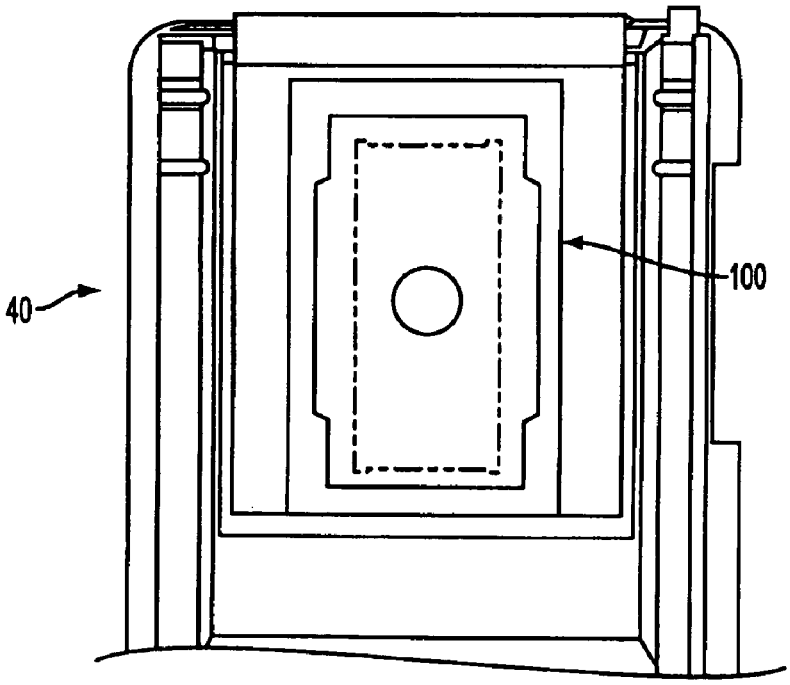
FIG. 6 is a bottom view of the inkjet cartridge of FIG. 4 covered by a cap.

The inkjet cartridge 40 of the present invention in one embodiment may be conceptually similar to and/or the same as prior inkjet cartridges that are commercially available. By way of example only and not by way of limitation, the HP inkjet cartridge of U.S. Pat. No. 6,260,961 would be similar to the inkjet cartridge of the first embodiment of the present invention. However, inkjet cartridges that are different conceptually than the typical inkjet cartridges can be used to practice the present invention. In one embodiment of the invention the inkjet cartridge 40 may have an electrical contact strip 42 that extends from one side of the inkjet cartridge around to another side of the inkjet cartridge, as can be seen in FIG. 4. The inkjet cartridge 40 has contacts 44 on the contact strip 42 to receive electrical signals from the printer 1000. On the contact strip is a nozzle plate 46. The nozzle plate 46 is a plate that protrudes and/or rises slightly from the surface of the contact strip 42. Nozzle plate 46 contains one or more nozzles 48 as is shown in FIG. 5 through which ink is ejected during printing. In one embodiment of the invention, the cap 100 sealingly covers the nozzle plate 46. However, in other embodiments of the present invention, it would be sufficient to simply sealingly cover the nozzles 48. That is, the cap 100 of the present invention may or may not cover the entire nozzle plate of the inkjet cartridge 40, depending on the configuration of the inkjet cartridge 40 and/or the configuration of the cap 100. In yet further embodiments of the present invention, the inkjet cartridge might not have a nozzle plate, but only nozzles. Thus, it would be sufficient to practice the invention by simply sealingly cover the nozzles. FIG. 6 shows a view of the first embodiment of the present invention where the cap 100 is sealing around the nozzle plate 46 and the nozzles 48 of the inkjet cartridge 40, in the manner in which will now be described.

As noted above, the present invention functions to sealingly cover, or otherwise form an air barrier between the nozzles of an inkjet cartridge or ink dispensing device and the ambient atmosphere. Thus, any device that will serve to form a removable air seal around the nozzles can be used as a cap in practicing the present invention. In one embodiment of the present invention, the cap is adapted to enable the consumable cartridge to be stored without printing for up to 18 months, with other embodiments enabling the consumable cartridge to be stored longer or shorter.

It is noted that the cap 100 of the first embodiment of the present invention is rectangular in shape. This rectangular shape is primarily a result of the fact that the nozzle plate 46 of the inkjet cartridge 40 of the present invention is also rectangular in shape. It is noted that other embodiments of the present invention can utilize caps 100 that are not rectangular in shape. By way of example and not by way of limitation, caps that are circular in shape, square in shape, oval in shape, triangular in shape, or pentagon in shape, or other shaped caps can be used to practice the invention. Still further, a variety of sizes and shapes and depths of the cap 100 can be used to practice the present invention. While the cap 100 of the present invention shown in the Figs. is long and narrow, having a relatively thin thickness in comparison to the other dimensions, caps that have a relative thick thickness can be used to practice the present invention as well. Any size or shape cap can be used to practice the present invention as long as that cap functions to create or help create an air seal between the nozzle of the inkjet cartridge and the atmosphere.

The consumable cartridge 10 includes the inkjet cartridge holding device 30 formed in the housing 15, as can be seen in FIG. 1*a*. In the first embodiment of the present invention, the inkjet cartridge holding device 30 is configured to hold and retain an inkjet cartridge 40 when the inkjet cartridge is not connected to the exemplary printer carriage of a printer (described below in greater detail). Furthermore, holding device 30 is configured to provide space for the inkjet cartridge while the inkjet cartridge is connected to a printer carriage. This is because the inkjet cartridge holding device 30 functions both as a device to hold and retain an inkjet cartridge, and as a place where an inkjet cartridge can be positioned so that it is clear of the print medium and other pertinent components of a printer while attached to the print carriage.

In one embodiment of the present invention, retention of the inkjet cartridge is accomplished by sidewalls 32 and 34 that provide a compressive force onto the sides of an inkjet cartridge 40. In this embodiment the sidewalls 32 and 34 are made from a resilient material so that the sidewalls will be deformed when the inkjet cartridge is placed in-between those sidewalls, thus providing a gripping force onto the sides of the inkjet cartridge and thereby retaining the inkjet cartridge in the holding device. In other embodiments of the present invention, the inkjet cartridge holding device utilizes a snap mechanism with prongs (not shown) that interface with gaps or spaces or lips (again also not shown) in the inkjet cartridge 40, thus providing positive retention of the inkjet cartridge 40 in the inkjet cartridge holding device 30. This can be accomplished in this embodiment, as above, due to the resiliency of the sidewalls. For example, as the inkjet cartridge 30 is placed in between sidewalls having prongs, the sidewalls will spread out a bit due to their resilient properties and then snap into the gaps/indentations in the inkjet cartridge. During removal of the inkjet cartridge from the inkjet cartridge holding device, the sidewalls will spread out a certain amount as releasing force is applied to the inkjet cartridge, thus releasing the inkjet cartridge from the holding device.

The inkjet cartridge holding device 30 is configured to permit and/or to enable the inkjet cartridge 40 to pivot so that the inkjet cartridge 40 can be connected to a printing carriage of a printer (discussed in greater detail below). While in the embodiments shown above, the end of the inkjet cartridge 40 that interfaces with the printing carriage (front) pivots downward into the printer carriage, other embodiments of the present invention could be utilized in a regime whereby the inkjet cartridge is connected to the print carriage in another manner, such as, by way of example and not limitation, moving the inkjet cartridge forward or moving the inkjet cartridge sideways, or pivoting the inkjet cartridge so that the front of the inkjet cartridge pivots upwards as opposed downward. Any form of movement in any manner that will result in the inkjet cartridge being connected to a printer carriage can be used to practice the present invention, and thus the consumable cartridge of the present invention would include any device that would accomplish such movement.

Still further, in other embodiments of the present invention, the inkjet cartridge 40 does not move when the inkjet cartridge is connected to the printer carriage. In such embodiments, the printer carriage (discussed in greater detail below) moves to connect to the inkjet cartridge 40. As with the inkjet cartridge, any movement of the printer carriage that will result in the attachment of the end cartridge to the printer carriage can be utilized to accomplish this result. Furthermore, a combination of movements of the inkjet cartridge and the printer carriage can be utilized to accomplish attachment.

Figure 7:
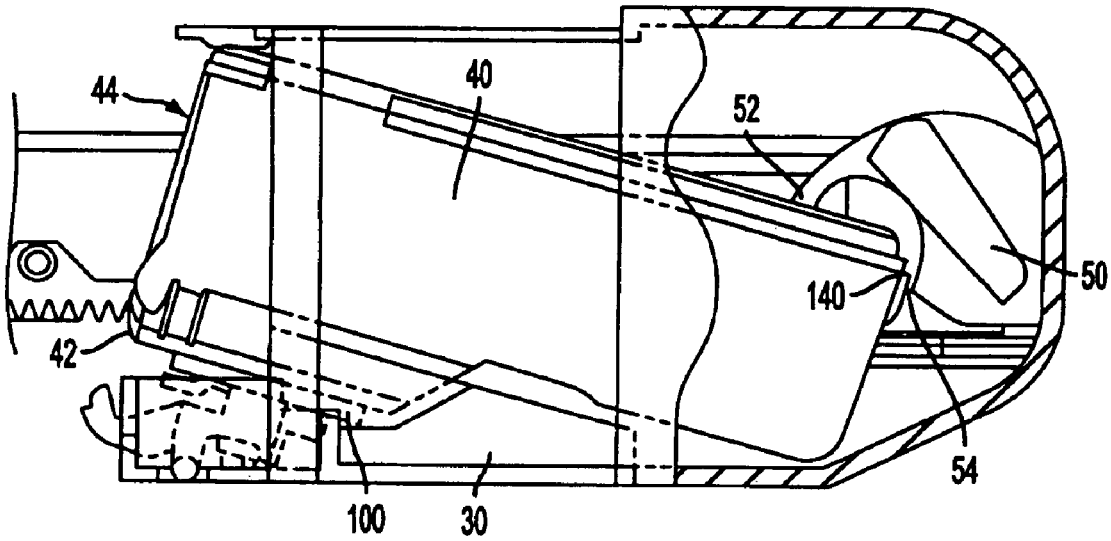
FIG. 7 is a side view of the exemplary consumable cartridge of FIG. 1.

FIG. 7 shows a side view of the first embodiment of the present invention, where the inkjet cartridge 40 is positioned in the inkjet cartridge holding device 30. In FIG. 7, the inkjet cartridge 40 is shown in the position where the consumable cartridge 10 is removed from a printer. Thus, in this embodiment of the invention, prior to the insertion of cartridge 10 into a printer, the inkjet cartridge 40 is roughly at a 30 degree angle from a horizontal plane. However, other embodiments of the present invention can have the inkjet cartridge 40 in a position where the inkjet cartridge 40 is canted at another angle less than 30 degrees or at an angle greater than 30 degrees. By way of example, the inkjet cartridge 40 can be canted at angles of about 0, 5, 10 15, 20, 25, 30, 35, 40, 45, 50, 55, 60, 65, 70, 75, 80, 85 and 90 degrees and/or any angles therebetween, or taken from the plane of insertion into the printer. Thus, a variety of angle orientations could be utilized to practice this embodiment of the present invention.

In the embodiment shown in FIG. 7, the inkjet cartridge 40 is positioned such that the contacts 44 on the contact strip 42 face towards the direction of insertion into the exemplary printer. Furthermore, the nozzle plate 46 and the nozzles 48 (see FIG. 5) face downwards or about downwards. As can be seen from FIG. 7, the cap 100 can be positioned against the bottom portion of the contact strip of the inkjet cartridge 40. FIG. 7 shows the cap 100 positioned sealingly against the contact strip 42 of the inkjet cartridge.

FIG. 7 shows a component 50 located in the rear portion (i.e. away from the other side having the contacts 44) of the inkjet cartridge 40. Component 50 is configured, in the first embodiment of the present invention as a latch, to pivot the inkjet cartridge from its 30 degree orientation seen in FIG. 7 to a horizontally or substantially horizontal orientation while the print cartridge is inside the exemplary printer and visa-versa. Component 50 of the embodiment shown in FIG. 7 has a finger 52 that is used to supply downward force on the top rear end of the inkjet cartridge 40, thus pivoting the inkjet cartridge 40 downwards by some number of degrees, such as 30 degrees. Component 50 also has a corner portion 54 that supplies an upward force to a protrusion 140 on the rear of the inkjet cartridge 40 to impart an upward force on the inkjet cartridge, thus aligning it with the direction of insertion of the consumable cartridge 10 into the exemplary printer. It is noted that while the configuration of the component 50 shows a finger 52 and a corner 54, other embodiments of the present invention can be utilized with components of a different configuration. By way of example only and not by way of limitation, two fingers can be used on the component 50. Alternatively, two corners can be used on the component 50 as well. Still further, two separate components could be used to practice the invention. By way of example and not by limitation, alternative embodiments could have a lever located underneath the inkjet cartridge and a lever located on top of the inkjet cartridge, whereby actuation of the respective levers would pivot the inkjet cartridge upwards or downwards. Accordingly, any device that can be used to move the inkjet cartridge 40 to pivot the inkjet cartridge can be used to implement this embodiment of the present invention. It is noted that pivoting the inkjet cartridge provides alignment with the exemplary printer. Thus, in the first embodiment of the present invention, the inkjet cartridge is horizontal with the direction of insertion of the consumable cartridge after it is pivoted. However, other exemplary printer configurations could require or utilize a cartridge where the cartridge was not in horizontal alignment with the direction of insertion. Thus, the component 50 is utilized to position the inkjet cartridge 40 in any position desirable or otherwise required to allow the inkjet cartridge to function with a printer. Therefore, the component 50 of the present invention, in its broadest sense, is a component to vary the position of the inkjet cartridge to allow the inkjet cartridge to interface with the printer.

In the embodiment shown in FIG. 7, as noted above, the inkjet cartridge is canted at about a 30 degree angle from the direction of insertion into the printer when the consumable cartridge is not installed into the printer. When the consumable cartridge 10 of the first embodiment of the invention is installed in the printer, the inkjet cartridge 40 remains at the 30 degree canted position until the operator "locks" the consumable cartridge into the printer, at which point the inkjet cartridge 40 is pivoted to the horizontal orientation. This is accomplished, in one embodiment of the present invention, by coupling component 50 to the locking mechanism (not shown) that the operator utilizes to lock the consumable cartridge into the printer. However, other embodiments of the present invention could be practiced where the latch or component 50 is not coupled to such a lock. By way of example and not by limitation, the component can be independent of such a lock, whereby the user would have to affirmatively actuate the component himself or herself to orient the inkjet cartridge. In other embodiments of the present invention, the component 50 could actuate itself upon insertion of the consumable cartridge into the printer. That is, the physical force associated with the act of inserting the consumable cartridge would cause the actuation of the component 50. Conversely, in one embodiment, removal of the consumable cartridge 10 from a printer would cause the component 50 to actuate in the reverse direction, thus pivoting the consumable cartridge 40 downward 30 degrees. In this embodiment, the act of "unlocking" the consumable cartridge from the printer causes the component to actuate and impart a downward force through fingers 52 of the component onto the rear of inkjet cartridge 40.

Figure 8:
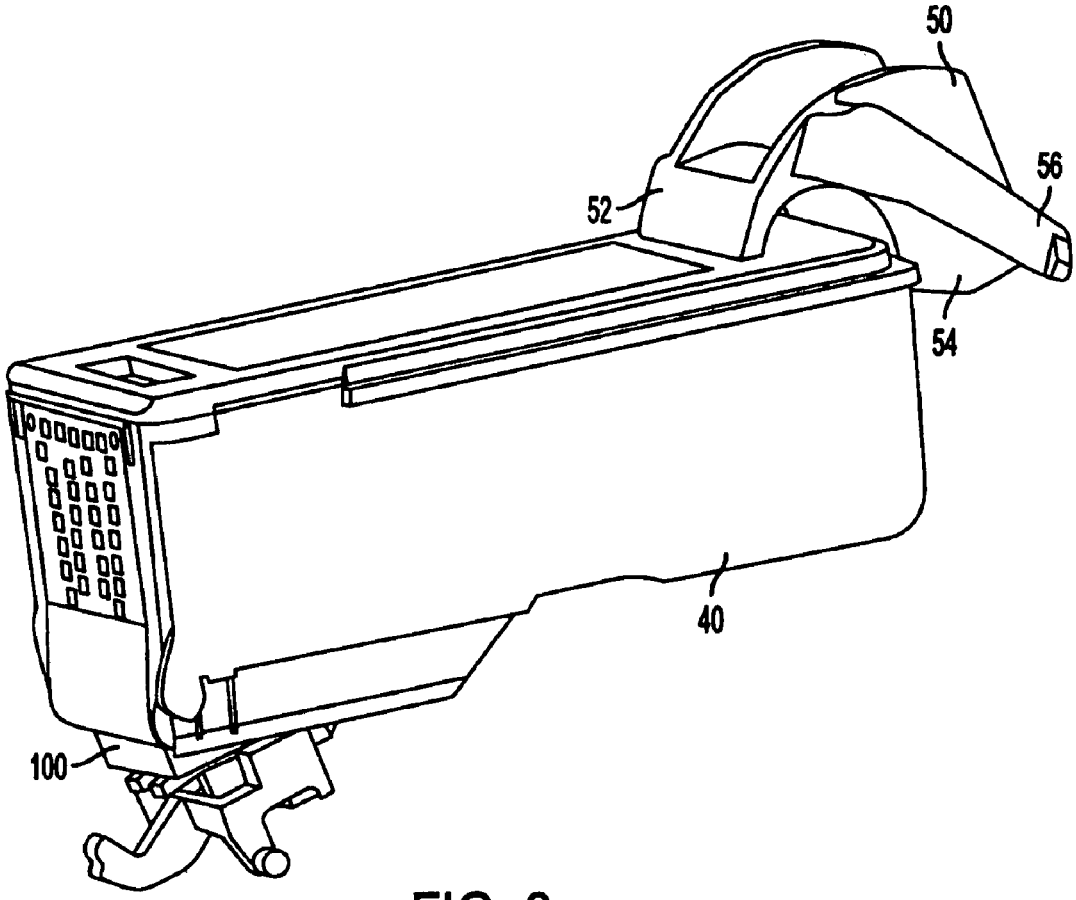
FIG. 8 is an isometric view of some of the exemplary components of the consumable cartridge of FIG. 1*a*.

FIG. 8 shows an isometric view of some of the components shown in FIG. 7, where the structure of a consumable cartridge has been removed for clarity and only component 50 and cap 100 and its associated actuator and support mechanisms are shown. As can be seen from FIG. 8, in this embodiment, component 50 has an actuator arm 56 that is connected to the locking mechanism (not shown) of the consumable cartridge to actuate or otherwise impart a force onto the component 50 so that the inkjet cartridge 40 will pivot.

It is noted that actuation of the component 50 is not limited to mechanical means. By way of example and not by way of limitation, electrical-mechanical means can be utilized to actuate the component 50, such as by way of example and not by limitation, a solenoid.

It is further noted that in one embodiment, the component mechanism 50 is utilized to pivot the inkjet cartridge out of a printer carriage in a printer prior to removing the consumable cartridge from the printer.

Figure 9:
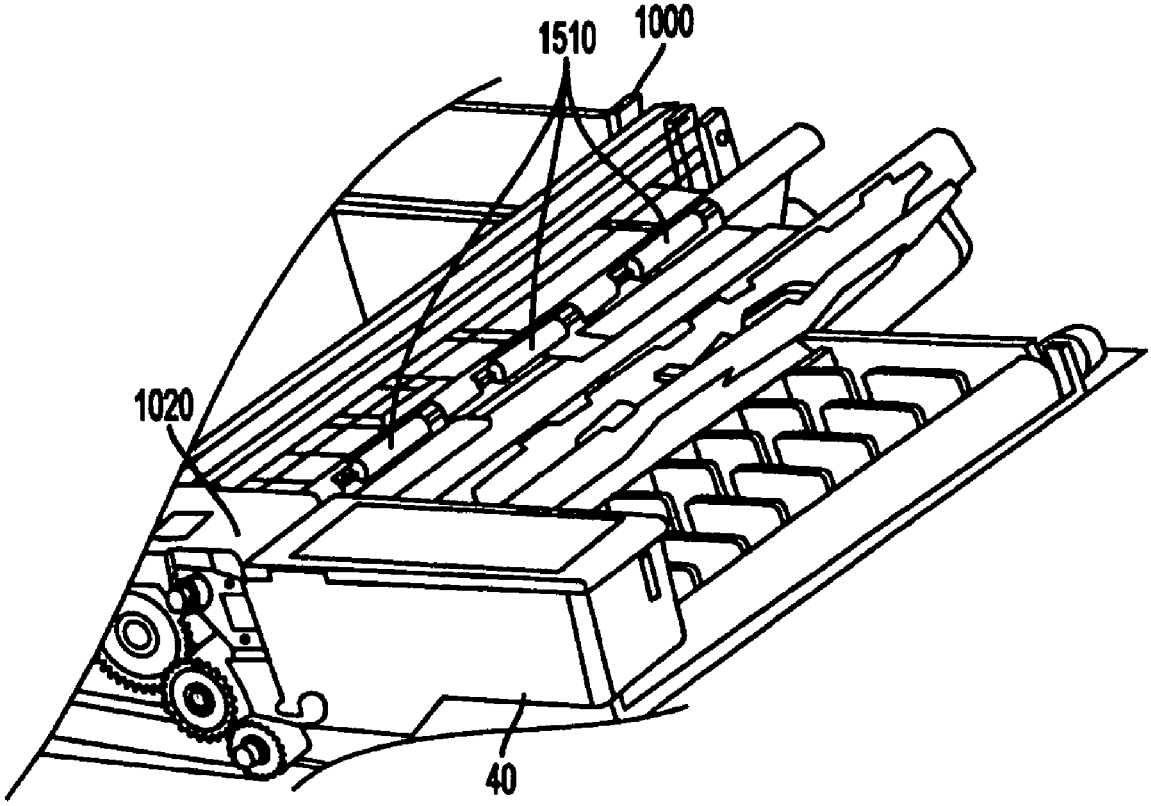
FIG. 9 shows the interior of the printer and consumable cartridge according to one exemplary embodiment of the invention.
Figure 10:
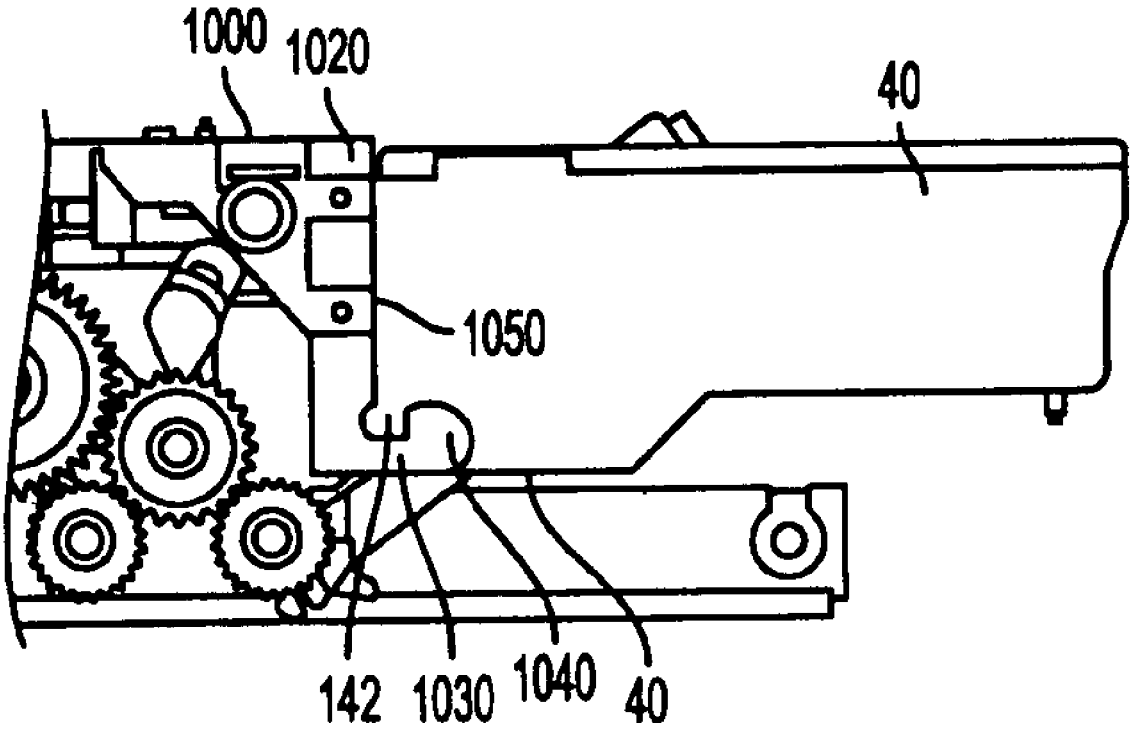
FIG. 10 is a side view of the exemplary embodiment shown in FIG. 9.

FIGS. 9 and 10 show views of portions of the inside of an exemplary printer 1000 according to an embodiment of the present invention, along with the inkjet cartridge 40. (The other portions of consumable cartridge 10 are not shown for clarity. It is further noted that the ink cartridge holding device 30 would be located around the inkjet cartridge 40). As can be seen, inkjet cartridge 40 is attached to a print carriage 1020. Print carriage 1020 is not a limiting embodiment and in some embodiments is of a design similar to or the same conceptually as current designs of printers using inkjet cartridges. However, other ink printer carriages of different conceptual designs can be utilized to practice invention as well. Accordingly, any print carriage that has as its function gripping and/or otherwise interfacing with an inkjet cartridge 40 and moving that inkjet cartridge along the printing media during printing can be used with the present invention. Alternatively, in other embodiments of the present invention, the print carriage may be stationary, where the printing media is moved during printing. FIG. 9 further shows print media rollers 1510, that interface with print media in the print media holding device 20, discussed in greater detail below.

In FIG. 10, the contacts (not shown) of the inkjet cartridge 40 face and contact connectors (also not shown) on the print carriage 1020. In the configuration shown in FIG. 10, the print cartridge is positioned, after it is attached to the print carriage 1020, so that the inkjet nozzles are substantially parallel and above the print media (e.g. a piece of paper) which also is not shown in FIG. 10. However, in the case of an inkjet cartridge 40 where the inkjet nozzles are aligned, for example on a canted surface, the inkjet cartridge 40 could be angularly attached to the printing carriage 1020.

As can be seen from FIGS. 9 and 10, the print carriage 1020 has one or more arms 1030 with one or more fingers 1040 that wrap around and grip fingers 142 on the inkjet cartridge 40, thus securing inkjet cartridge 40 to the carriage 1020 when the fingers 142 are between the fingers 1040 of the printing carriage and the face of the printing carriage 1050.

From FIG. 10, one embodiment of a relationship between the pivoting action of the inkjet cartridge 40 described above and the printer carriage 1020 can clearly be seen. That is, by pivoting the front of the inkjet cartridge 40, upward and/or the rear downward, the fingers 142 are removed from between fingers 1040 and wall 1050 of the print carriage 1020. Conversely, when component 50 imparts an upward force on the rear of the inkjet cartridge 40, the front of the cartridge pivots downward and the fingers 142 of the inkjet cartridge 40 slide in-between fingers 1040 and face 1050 of the printing carriage 1020, thus securing the inkjet cartridge to the print carriage 1020.

In one embodiment of the present invention, during printing utilizing an exemplary printer described above with the consumable cartridge 10, the printing carriage 1020 moves the inkjet cartridge 40 linearly across the printing media while ink is deposited from the nozzles of the inkjet cartridge onto the paper. When printing is completed and/or otherwise paused, the print carriage can bring the inkjet cartridge 40 over to the inkjet cartridge holding device 30, which is to one side of the printing media. It is in this location where the inkjet cartridge can be sealed.

Figure 11:
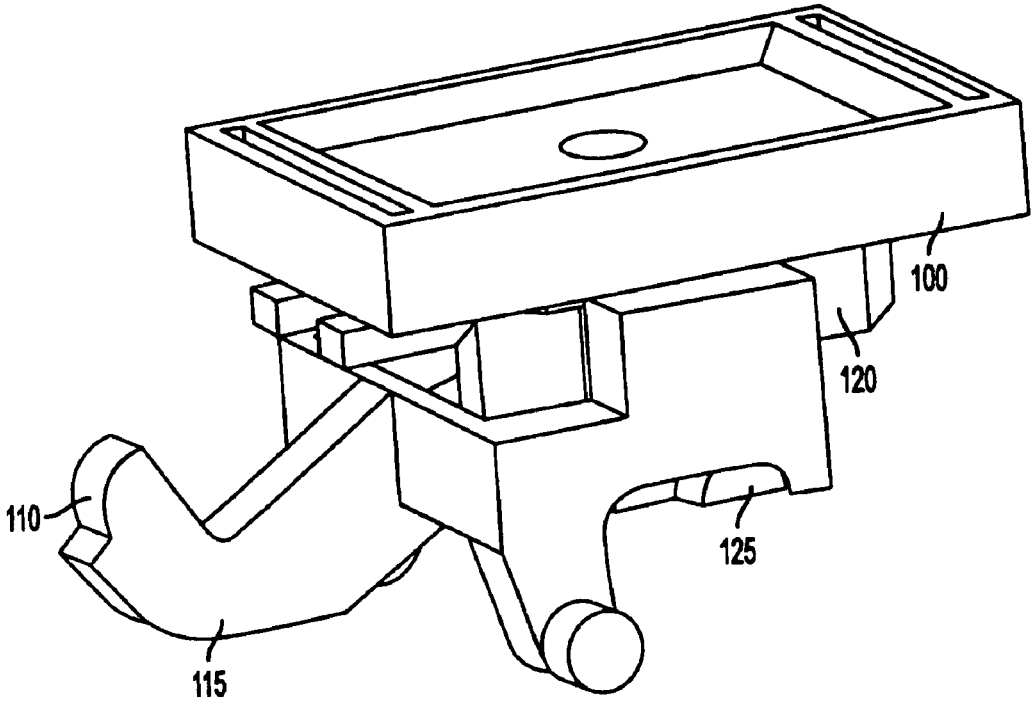
FIG. 11 is a view of some of the exemplary components shown in FIG. 1*a*.
Figure 12:
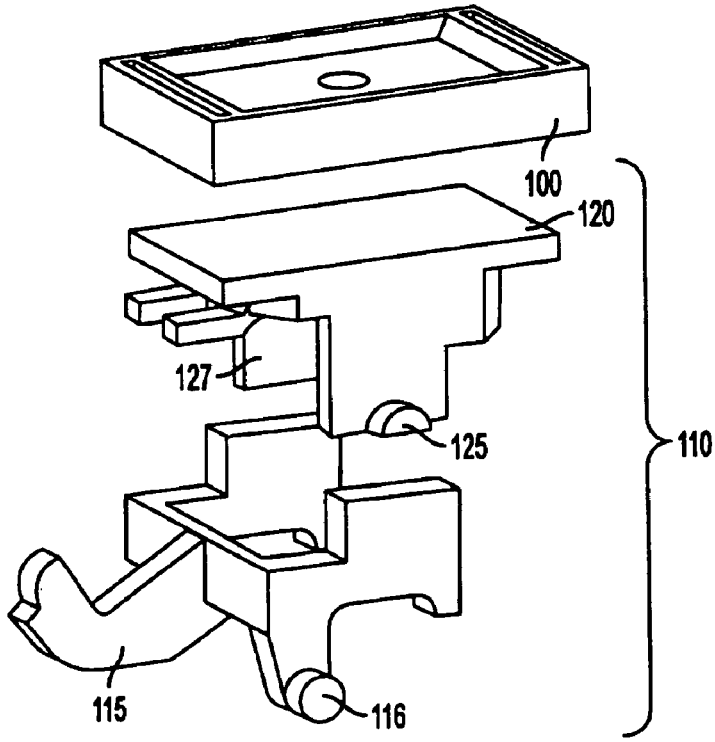
FIG. 12 is an exploded view of the exemplary components shown in FIG. 11.

The actuating mechanism and the articulation of the cap 100 will now be discussed. FIG. 11 shows one embodiment of the cap 100 with actuator 110. In the embodiment shown, there is an actuator lever 115 for actuating cap platform 120. FIG. 12 shows an exploded view of the components shown in FIG. 11. In the embodiment shown, cap 100 is attached to cap platform 120 via a press-fit, the cap platform 120 being provided with lugs 125 that interface with lever 115. In another embodiment, cap 100 is connected to cap platform 120 with adhesive. In the embodiment shown in FIGS. 11 and 12, lever 115 has fulcrum lugs 116 that connect to and/or otherwise interface with inkjet cartridge holding device 30 at receptacles (not shown) in a rotating and/or pivoting manner. This allows for lever 115 to pivot about a fixed point in the consumable 10. Cap platform 120 interfaces with actuator lever 115 and moves with cap 100. Not shown in FIG. 12 is a spring positioned between a portion of holding device 30 and platform 120 in slot 127. In the first embodiment, a helical spring is used which imparts an upward force on platform 120. Due to the fact that lugs 125 extend below and past the lower portions of lever 115, th upward force of the spring on the platform 120 imparts an upward force onto lever 115, thus causing lever 115 to have a bias to pivot so that cap 100 is raised upward.

In one embodiment, the cap 100 is raised upward so that it sealingly interfaces with the inkjet cartridge 40, thus forming an air barrier between the nozzles of the inkjet cartridge and the ambient air. In one embodiment, the helical spring discussed above is configured and positioned to provide upward force onto the platform 120 so that the cap 100 provides a sufficient seal around the nozzles. In other embodiments of the present invention, a solenoid can be used to provide the force. Still further, leaf springs can be used to provide the upward force. In yet further embodiments of the present invention, a pulley system can be used to provide the upward force. Alternatively or in addition to this, an electric motor can be utilized to provide a rotation force at the pivots 116, thus imparting an upward and/or downward force to the platform 120 and thus the cap 100. Accordingly, any device that can be utilized to provide a force about the pivot 116 can be utilized to practice the invention.

In one embodiment, the pivoting motion is controlled by the lever arm 115. For example, in one embodiment, lever 115, on one side of the pivot 116 interfaces with a mechanism in the exemplary printer 1000 that imparts a force upwards and/or downwards onto lever 115. In one embodiment, due to the helical spring imparting an upward force on the platform 120 on one side of the pivot 116, the mechanism of the exemplary printer need only impart an upward force onto the lever 115 on the opposite side of the pivot 116, thus counteracting the upward force of the helical spring. Accordingly, in one embodiment of the present invention, the exemplary printer utilizes a mechanism to impart only an upward force onto the lever, where a mechanism to release the lever or otherwise release the force is provided so that the lever is free to move downward thus permitting the spring to "spring" the cap upwards against the inkjet cartridge 40. In yet other embodiments of the present invention, the printer is configured with a device that will impart both upwards and downwards force onto the lever 115. In yet still further embodiments of the present invention, there is no spring or any device to impart a force. In such an embodiment the force is supplied entirely by the printer, and a ratchet system is used to maintain the location of the cap 100. Accordingly, any device that can be utilized to impart a force that will result in movement of the cap 100 can be utilized to practice the present invention.

As can be inferred from the figures in the above discussion, the cap 100 of the first embodiment of the present invention remains sealingly attached and/or otherwise sealingly interfaces the inkjet cartridge 40 when the inkjet cartridge 40 is in the horizontal position, as shown in FIG. 10, as well as in the pivoted position, where the inkjet cartridges are at a thirty degree angle from the direction of insertion of the consumable cartridge 10 into the printer. Still further, in one embodiment the cap and actuator system of the present invention is configured to rotate or pivot with the inkjet cartridge 40, thus preserving the seal between the nozzle and the ambient air as the inkjet cartridge rotates. However, in other embodiments of the present invention, it is sufficient that the cap sealingly interface with the inkjet cartridge 40 only when it is canted at the thirty degree position and when it is in the horizontal position, as the transient time between those two positions in some embodiments is relatively limited. However, in the first embodiment of the present invention, the cap does travel with the inkjet cartridge 40 as it pivots. Because of the spring on one side of the pivot 116, a force is applied against the cap that pushes the cap against the inkjet cartridge 40 as it pivots, thus preserving a seal between the nozzles and the ambient air.

As noted above, in one embodiment the inkjet cartridge remains in the horizontal position and connected to a printing carriage even while no printing is taking place. In such instances, the consumable cartridge 10 of the present invention, in combination with the exemplary printer 1000, is configured such that the exemplary printer will actuate lever 115 when inkjet cartridge 40 is connected to printing carriage 1020. That is, cap 100 can be used to seal the nozzles of the inkjet cartridge 40 in-between printing operations. To unseal the nozzles, cap 100 is moved from the ink cartridge 40. Thus, in this embodiment, the exemplary printer 1000 controls the actuation of cap 100 in relation to the inkjet cartridge 40 based on a given printing operation of the present invention. However, in other embodiments of the present invention, the cap actuation device 110 can be configured so that it actuates upon an unlocking of the consumable 10 from the exemplary printer 1000, or alternatively or in addition to this when there is a locking of the consumable 10 into the exemplary printer 1000, similar to or in the same way as described in regard to the component 50 above which are incorporated herein in regard to the cap 100 by reference. In other embodiments of the present invention, the force of the consumable cartridge 10 generated to place consumable 10 into a printer and/or to remove consumable 10 from a printer can be utilized to actuate the cap actuation system as well. Thus, the present invention can be practiced with a device whereby the actuator is only actuated when the device is removed and installed from a printer. That is, in such a configuration, the cap 100 only seals the inkjet cartridge 40 while the consumable 10 is removed from the printer. Still further, in other embodiments of the present invention, the just mentioned configuration can be combined with a device that seals the cap in-between printing as well.

Thus, the cap can be closed while the consumable 10 is in the exemplary printer 1000. Still, in some embodiments, the exemplary printer 1000 controls the actuation of the inkjet cartridge 40. Still further, in other embodiments of the present invention, the actuator 110 can be configured such that the cap is automatically actuated to seal the inkjet cartridge 40 when the inkjet cartridge 40 is brought to the inkjet cartridge holding device 30. That is, the printer indirectly controls the actuation of the cap actuator 110. This can be accomplished, by way of example and not by limitation, via a lever system whereby one end of the lever is struck by the inkjet cartridge 40 when the inkjet cartridge 40 enters the inkjet cartridge holding device, at which point the cap 100 is actuated upward to seal the inkjet cartridge 40. Accordingly, any device that will result in movement of cap 100 to seal the nozzles of inkjet cartridge 40 from the ambient air can be used to practice the present invention.

In yet other embodiments of the present invention, the inkjet cartridge 40 can be moved to the cap 100, as opposed to cap 100 being moved to interface with the inkjet cartridge 40. That is, no actuator 110 system is necessary to actuate the cap as the movement of the inkjet cartridge 40 onto the cap 100 results in the creation of a seal between the nozzles and the ambient air. Still further, in other embodiments of the present invention, the combination of the movement of the inkjet cartridge 40 in conjunction with the movement of cap 100 can be utilize to create a seal around the nozzle of the inkjet cartridge 40. That is, both the cap 100 and the inkjet cartridge 40 can be moved to form the seal.

In one embodiment of the present invention, print media holding device 20 is configured to hold 4×6 inch photograph quality print media developed specifically for inkjet printing, where the print media has a 9–11 mil thickness and a glossy or matte finish, so that digital photo quality printing with the printer can be executed. In this embodiment of the present invention, the print media holding device 20 holds about 40 sheets of separate print media, while in other embodiments of the present invention, print media holding device holds 30 sheets or 50 sheets. If a thinner media is used, more sheets could be held in the print media holding device. If a thicker media is used, less sheets would be held. In other embodiments of the present invention, 100 sheets are held in the print media holding device.

In one embodiment of the present invention, print media holding device has a rectangular cross section and is configured to be larger than the volume of the combined media contained in the holding device when that media is laid flat, one on top of the other.

Figure 13:
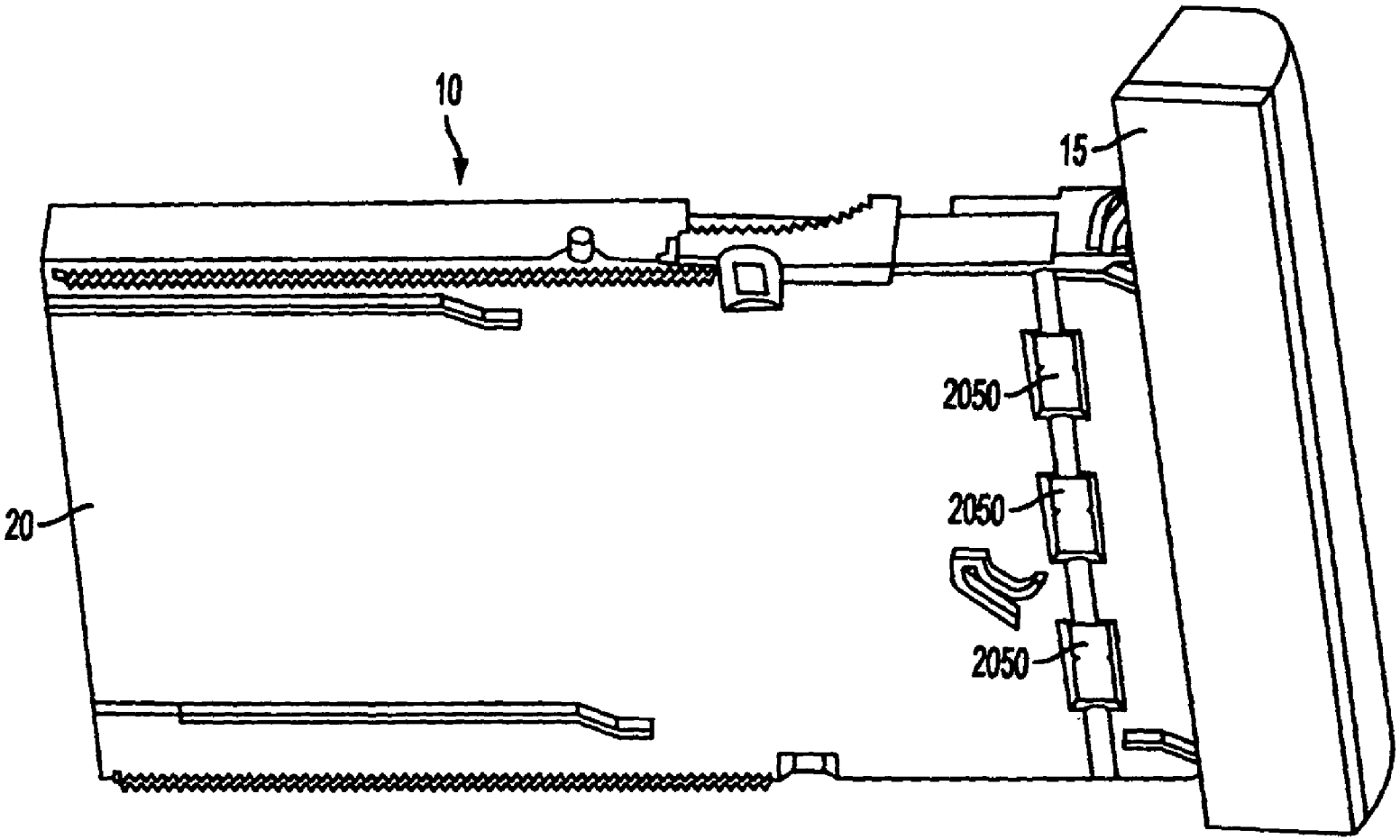
FIG. 13 is an isometric bottom view of the print media holding device of FIG. 1*a* with some of the components removed for clarity.

In one embodiment of the present invention, print media holding device 20 is configured with three roller access slots 2050 to allow the printer rollers access to the print media. In the embodiment of FIG. 13, the roller access slots 2050 are shown at the bottom of the device close to the housing 15 of the consumable 10 (other components of the consumable 10, such as the inkjet cartridge holding device 30 are not shown for clarity). The printer rollers 1510 are linked to an axle that, once the consumable is inserted into the exemplary printer 1000, interfaces with a drive member in the exemplary printer 1000 so that a rotational force can be imparted onto the drive axle. From the rotational force imparted on the axle, the rollers rotate and, via friction between the rollers and the print media, push a sheet of printing media out of the media holding device so that printing can take place. The drive system just described for pushing or pulling print media out of the print media holding device is conceptually similar to or the same as devices that are currently used to move paper and/or other sheets of printing media in inkjet printers or other printers that are currently available. However, other embodiments of the present invention can utilize a device to move print media that is not conceptually similar to devices currently available. Accordingly, any device that is capable of moving print media to printer and then positioning the print media so that it can be obtained by the end user can be utilized to practice the present invention.

It is noted that while the embodiment shown in the Figs. depicts a print media holding device where the media sheets travel parallel to the direction of insertion of consumable cartridge 10 into the exemplary printer 1000 the invention is not so limited. Other embodiments of the present invention can be utilized whereby the printing media travels in another direction, such as, by way of example and not by limitation, in the vertical direction or a direction normal to the direction of insertion. Thus, the present invention can be practiced with a variety of devices used to move or manipulate printing media in a variety of directions.

It is noted that while in some embodiments of the present invention, a consumable cartridge 10 has an inkjet cartridge and a print media housing device, other embodiments of the present invention can be utilized with a consumable cartridge that does not contain a print media holding device. In such embodiments the inkjet consumable cartridge only contains a inkjet cartridge and its ancillary supporting components, such as cap 100 and actuator 110.

It is noted that the present invention comprises a printer that is compatible with a consumable cartridge of the present invention. Other embodiments of the present invention can be used with other types of printers. In various embodiments, the exemplary printer 1000 is an inkjet printer suitable for printing digital photographs to photographic-quality paper design specially for inkjet printing. However, other embodiments of the present invention can be utilized in inkjet printers that are utilized for general printing and print to paper. Still further, other embodiments of the present invention can be utilized in any type of inkjet printer as long as the printer utilizes an inkjet cartridge that has nozzles.

Additionally, it is noted that in other embodiments of the present invention, the print media holding device 20 does not extend through the printer.

The foregoing descriptions of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet consumable cartridge, comprising:

an inkjet cartridge having nozzles;

an inkjet cartridge holding device for holding the inkjet cartridge;

a cap configured to interface with the inkjet cartridge; and a cap actuator that, when actuated, moves the cap from a position where the cap does not interface with the inkjet cartridge to a position where the cap interfaces with the inkjet cartridge sealingly covering the nozzles; wherein the consumable cartridge is removable from a printer as a self-contained unit.

2. The apparatus of claim 1, wherein the cap interfaces with the inkjet cartridge at a nozzle plate on the inkjet cartridge.

3. The apparatus of claim 1, wherein the cap maintains a high humidity environment around nozzles in the inkjet cartridge when the inkjet cartridge is in the inkjet cartridge holding device and the cap interfaces with the inkjet cartridge.

4. The apparatus of claim 3, wherein the inkjet cartridge holding device permits the inkjet cartridge to move while inside the inkjet cartridge holding device.

5. The apparatus of claim 4, wherein the inkjet cartridge holding device permits the inkjet cartridge to pivot while inside the inkjet cartridge holding device.

6. The apparatus of claim 5, further comprising a component that pivots the inkjet cartridge while the consumable cartridge is installed into a printer.

7. The consumable cartridge of claim 6, wherein the cap actuator comprises an actuator arm that interfaces with a printer and reacts to a force imparted to the arm by the printer.

8. The consumable cartridge of claim 7, wherein the cap actuator holds the cap around the nozzles of the inkjet cartridge while the cartridge pivots.

9. The apparatus of claim 8, wherein the component that pivots the inkjet cartridge when operated, mechanically connects to a device that locks the printer cartridge to the printer and pivots the inkjet cartridge when the printer cartridge is locked into a printer.

10. The apparatus of claim 4, wherein the inkjet cartridge holding device permits the inkjet cartridge to pivot and connect to a printer carriage in a printer when the consumable cartridge is installed into the printer.

11. The apparatus of claim 10, wherein the cap actuator, when actuated, moves the cap to interface with the inkjet cartridge and maintain a high humidity environment around nozzles in the inkjet cartridge while the inkjet cartridge is connected to the printer carriage.

12. The apparatus of claim 11, wherein the cap actuator, when actuated, moves the cap from interfacing with the inkjet cartridge while the inkjet cartridge is connected to the printer carriage.

13. The apparatus of claim 11, wherein the inkjet cartridge holding device retains the inkjet cartridge when the consumable cartridge is removed from a printer.

14. The apparatus of claim 13, wherein the actuator holds the cap against the inkjet cartridge to maintain a high humidity environment around nozzles in the inkjet cartridge when the consumable cartridge is removed from a printer.

15. The apparatus of claim 1, wherein the cap comprises an elastomeric material.

16. The apparatus of claim 15, wherein the cap is substantially rectangular in shape.

17. The apparatus of claim 16, wherein the cap has four side-walls forming the sides of the rectangle and a bottom surface, an open space being present between the four walls and the bottom surface, the space adapted to encompass the nozzles of the inkjet cartridge when the cap interfaces with the inkjet cartridge.

18. The apparatus of claim 17, wherein the cap is of a monolithic structure.

19. The apparatus of claim 1, wherein the consumable cartridge pivots the inkjet cartridge about 30 degrees when the inkjet cartridge is in the inkjet cartridge holding device.

20. A printer utilizing the consumable cartridge of claim 1.

21. Printer according to claim 20, where the cap interfaces with the inkjet cartridge until the consumable cartridge is installed in the printer and a print command is received by the printer.

22. A method of making an inkjet consumable cartridge, comprising:

obtaining an inkjet cartridge having nozzles;

placing the inkjet cartridge in an inkjet cartridge holding device;

obtaining a cap configured to interface with the inkjet cartridge;

attaching the cap to a cap actuator; and attaching the cap actuator with the cap to the inkjet cartridge holding device such that, when actuated, the cap actuator moves the cap from a position where the cap does not interface with the inkjet cartridge to a position where the cap interfaces with the inkjet cartridge sealingly covering the nozzles; wherein the consumable cartridge, which includes the inkjet cartridge, the inkjet cartridge holding device, the cap, and the cap actuator, is removable from a printer as a self-contained unit.

23. The method of claim 22, wherein the cap maintains a high humidity environment around nozzles in the inkjet cartridge when the inkjet cartridge is in the inkjet cartridge holding device and the cap interfaces with the inkjet cartridge.

24. An inkjet consumable cartridge, comprising:

an inkjet cartridge having nozzles;

a print media holding device;

an inkjet cartridge holding device for holding the inkjet cartridge;

a cap configured to interface with the inkjet cartridge; and a cap actuator that, when actuated, moves the cap from a position where the cap does not interface with the inkjet cartridge to a position where the cap interfaces with the inkjet cartridge sealingly covering the nozzles; wherein the consumable cartridge is removable from a printer as a self-contained unit.

25. The apparatus of claim 24, wherein the cap interfaces with the inkjet cartridge at a nozzle plate on the inkjet cartridge.

26. The apparatus of claim 24, wherein the cap maintains a high humidity environment around nozzles in the inkjet cartridge when the inkjet cartridge is in the inkjet cartridge holding device and the cap interfaces with the inkjet cartridge.

27. The apparatus of claim 27, wherein the inkjet cartridge holding device permits the inkjet cartridge to move while inside the inkjet cartridge holding device.

28. The apparatus of claim 27, further comprising a component that pivots the inkjet cartridge while the consumable cartridge is installed into a printer.

29. The consumable cartridge of claim 28, wherein the cap actuator comprises an actuator arm that interfaces with a printer and reacts to a force imparted to the arm by the printer.

30. The consumable cartridge of claim 29, wherein the cap actuator holds the cap around the nozzles of the inkjet cartridge while the cartridge pivots.

31. The apparatus of claim 27, wherein the inkjet cartridge holding device permits the inkjet cartridge to pivot and connect to a printer carriage in a printer when the consumable cartridge is installed into the printer.

32. The apparatus of claim 31, wherein the cap actuator, when actuated, moves the cap to interface with the inkjet cartridge and maintain a high humidity environment around nozzles in the inkjet cartridge while the inkjet cartridge is connected to the printer carriage.

33. The apparatus of claim 32, wherein the cap actuator, when actuated, moves the cap from interfacing with the inkjet cartridge while the inkjet cartridge is connected to the printer carriage.

34. The apparatus of claim 32, wherein the inkjet cartridge holding device retains the inkjet cartridge when the consumable cartridge is removed from a printer.

35. The apparatus of claim 34, wherein the actuator holds the cap against the inkjet cartridge to maintain a high humidity environment around nozzles in the inkjet cartridge when the consumable cartridge is removed from a printer.

36. The apparatus of claim 24, wherein the cap comprises an elastomeric material.

37. The apparatus of claim 36, wherein the cap is substantially rectangular in shape.

38. The apparatus of claim 37, wherein the cap has four side-walls forming the sides of the rectangle and a bottom surface, an open space being present between the four walls and the bottom surface, the space adapted to encompass the nozzles of the inkjet cartridge when the cap interfaces with the inkjet cartridge.

39. The apparatus of claim 38, wherein the cap is of a monolithic structure.

40. The apparatus of claim 24, wherein the consumable cartridge pivots the inkjet cartridge about 30 degrees when the inkjet cartridge is in the inkjet cartridge holding device.

41. The apparatus of claim 24, wherein the print media holding device comprises at least one access slot allowing at least one printer roller to interface with and move print media.

42. The apparatus of claim 41, wherein the print media holding device comprises a plurality of access slots allowing a plurality of print rollers to interface with and move print media.

43. The apparatus of claim 42, wherein the print media holding device comprises a hollow rectangular box with an opening in at least one end, the box protruding away and to the side of the inkjet cartridge.

44. The apparatus of claim 43, wherein the consumable cartridge further comprises print media.

45. The apparatus of claim 44, wherein the print media is digital photograph paper.

46. A printer utilizing the consumable cartridge of claim 24.

47. Printer according to claim 46, where the cap interfaces with the inkjet cartridge until the consumable cartridge is installed in the printer and a print command is received by the printer.

48. A method of making an inkjet consumable cartridge, comprising:

obtaining an inkjet cartridge having nozzles;

placing the inkjet cartridge in an inkjet cartridge holding device;

obtaining a cap configured to interface with the inkjet cartridge;

obtaining a print media holding device;

attaching the cap to a cap actuator;

attaching the cap actuator with the cap to the inkjet cartridge holding device such that, when actuated, the cap actuator moves the cap from a position where the cap does not interface with the inkjet cartridge to a position where the cap interfaces with the inkjet cartridge sealingly covering the nozzles; and attaching the print media holding device to at least one component of the inkjet consumable cartridge, wherein the consumable cartridge is a self-contained unit.

49. The method of claim 48 wherein the cap maintains a high humidity environment around nozzles in the inkjet cartridge when the inkjet cartridge is in the inkjet cartridge holding device and the cap interfaces with the inkjet cartridge.

* * * * *

UNITED STATES PATENT AND TRADEMARK OFFICE

CERTIFICATE OF CORRECTION

PATENT NO. : 7,029,091 B2
APPLICATION NO. : 10/633619
DATED : April 18, 2006
INVENTOR(S) : Joseph Stellbrink et al.

It is certified that error appears in the above-identified patent and that said Letters Patent is hereby corrected as shown below:

In column 14, line 51, in Claim 27, delete “claim 27,” and insert -- claim 26, --, therefor.

In column 15, line 38, in Claim 42, delete “print rollers” and insert -- printer rollers --, therefor.

Signed and Sealed this

Fifth Day of May, 2009

John Doll

JOHN DOLL
*Acting Director of the United States Patent and Trademark Office*